United States Patent [19]

Bendock

[11] 4,279,396

[45] Jul. 21, 1981

[54] SHOWER CURTAIN CLIP

[76] Inventor: Edward M. Bendock, 35 S. Franklin Ave., Lynbrook, N.Y. 11563

[21] Appl. No.: 121,703

[22] Filed: Feb. 15, 1980

[51] Int. Cl.[3] ..... F16B 47/00

[52] U.S. Cl. ..... 248/206 R; 24/255 R; 248/316 D

[58] Field of Search ..... 248/206 R, 316 D; 24/73 R, 73 VA, 73 CH, 73 AS, 73 B, 73 PF, 81 DS, 255 R, 259 R; 160/349 R, 349 D, 402

[56] References Cited

U.S. PATENT DOCUMENTS

| | | | |
|---|---|---|---|
| 2,505,899 | 5/1950 | Jobe | 248/206 R |
| 3,164,126 | 1/1965 | Matel et al. | 24/255 R X |
| 3,309,052 | 3/1967 | Borisof | 24/255 R X |
| 3,395,428 | 8/1968 | Schnabel | 24/73 R X |

FOREIGN PATENT DOCUMENTS

| | | | |
|---|---|---|---|
| 398921 | 3/1966 | Switzerland | 248/316 D |

*Primary Examiner*—J. Franklin Foss

[57] ABSTRACT

A two-piece shower curtain holder is provided which includes a resilient plastic, generally U-shaped, clip and a rubber suction cup secured to the clip. The clip has two arms which cooperate with one another to frictionally engage and releasably secure an edge portion of a shower curtain therebetween. The suction cup is releasably secured to a tub wall or enclosure wall thereof, so as to hold the clip and, in turn, the shower curtain against the wall, thereby preventing billowing of the curtain and escape of water from the tub enclosure.

2 Claims, 4 Drawing Figures

SHOWER CURTAIN CLIP

BACKGROUND OF THE INVENTION

This invention relates to a shower curtain holder. More particularly, it relates to a two-piece shower curtain holder which includes a resilient plastic U-shaped clip which is frictionally securable to a shower curtain edge portion and a rubber suction cup which is secured to the clip and is releasably securable to a tub or shower stall wall enclosure.

Various types of shower curtain holders have been previously proposed to secure a shower curtain against a tub sidewall so as to prevent billowing thereof and to contain the shower water spray to the tub or shower enclosure. For example, magnet-type curtain holders have been proposed which are either embedded in he lower edge of the shower curtain (See U.S. Pat. Nos. 3,107,361 and 2,212,326) or are secured thereto by means of a snap-action button (See U.S. Pat. No. 3,282,328). However, these types of holders have been found to be undesirable since they are neither suitable for non-magnetic or non-metal based shower stalls nor ceramic or porcelain walls. In addition, the snap-button type holders damage some shower curtains and are not particularly suitable for thick curtains.

Various suction-type curtain holders have also been proposed (See U.S. Pat. Nos. 2,764,382; 2,232,194; 2,293,833; 2,608,250; 2,303,502; 2,148,401; and 2,131,156) but these have also been found to be particularly disadvantageous due to their rather expensive and complicated construction, as well as their rather cumbersome manner of employment.

Accordingly, it is an object of the present invention to provide a novel curtain holder which may be used to secure a shower curtain against any type of shower, tub or wall surface, without causing damage to the shower curtain.

It is a further object of the present invention to provide such a novel curtain holder which is simple in construction, easy to use, durable and reliable in operation.

It is a more particular object of the present invention to provide a novel two-piece suction-type curtain holder having the foregoing attributes and characteristics which is economical to fabricate and produce.

SUMMARY OF THE INVENTION

Certain of the foregoing and related objects are readily attained in a shower curtain holder embodying the present invention which includes means for detachably securing the curtain holder to an edge portion of a shower curtain and a rubber suction cup secured to the curtain holder for detachably securing the curtain holder and, in turn, the edge portion of a shower curtain secured thereto to a tub or wall surface.

Preferably, the curtain holder includes a resilient, plastic, generally U-shaped clip having first and second arms which cooperate to frictionally engage an edge portion of a shower curtain inserted therebetween. Most desirably, the first arm comprises an elongated, flat rectilinear strip having an inner and outer side surface and the second arm comprises an elongated, flat, generally S-shaped strip having a lower end portion which merges with the first arm and an upper end portion which is disposed closely adjacent to at least a portion of the inner side surface of the first arm so as to cooperate therewith and frictionally engage an edge portion of a shower curtain inserted therebetween. Most advantageously, the suction cup is secured to the outer side surface of the first arm.

DETAILED DESCRIPTION OF THE ILLUSTRATED AND PREFERRED EMBODIMENT

Figure 1:
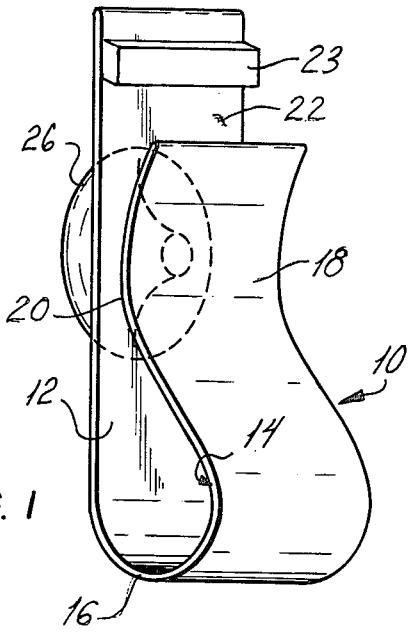
FIG. 1 is a perspective view of a novel shower curtain holder embodying the present invention.

Turning now, in detail, to the drawing, therein illustrated is a novel shower curtain clip holder embodying the present invention which includes a generally U or hook-shaped, resilient plastic clip 10. Clip 10 includes an elongated, flat, rectilinear first arm 12, and an elongated, flat, generally S-shaped second arm 14.

Figure 2:
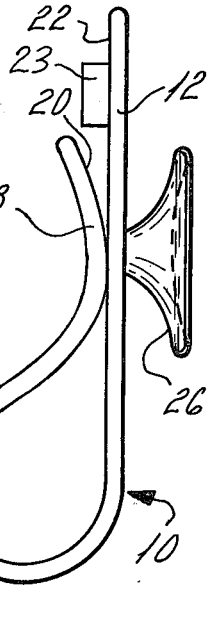
FIG. 2 is a side elevational view of the holder shown in FIG. 1.
Figure 3:
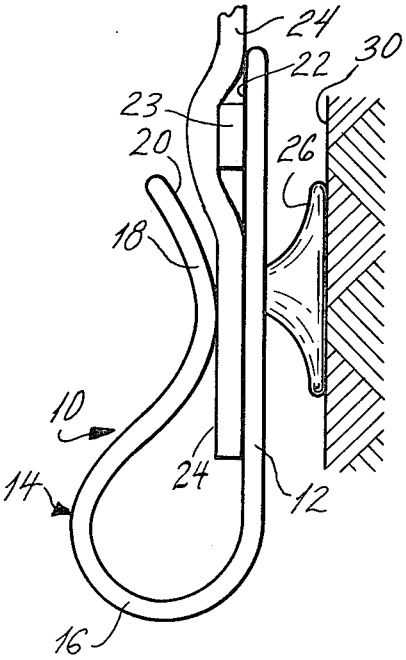
FIG. 3 is a side elevational view of the holder showing it securing an edge portion of a shower curtain to a shower wall surface.

As seen in FIG. 2, second arm 14 has a lower concave end segment 16 which merges with the lower end of first arm 12 and an upper convex segment 18, the inner side surface 20 of which is disposed closely adjacent to a portion of the inner side surface 22 of first arm 12. Convex segment 18 cooperates with inner side surface 22 of first arm 12 to frictionally engage an edge portion 24 of a shower curtain inserted therebetween, as shown in FIG. 3.

The boss 23 on the inner side of the first arm facilitates grasping of the curtain for removal from the surface to which it adheres.

A rubber suction cup 26 is secured to the outer side surface of first arm 12. As shown in FIG. 3, cup 26 serves to secure clip 10 and, in turn, edge portion 24, to a side of a tub, a tub enclosure wall or shower stall wall surface 30.

Figure 4:
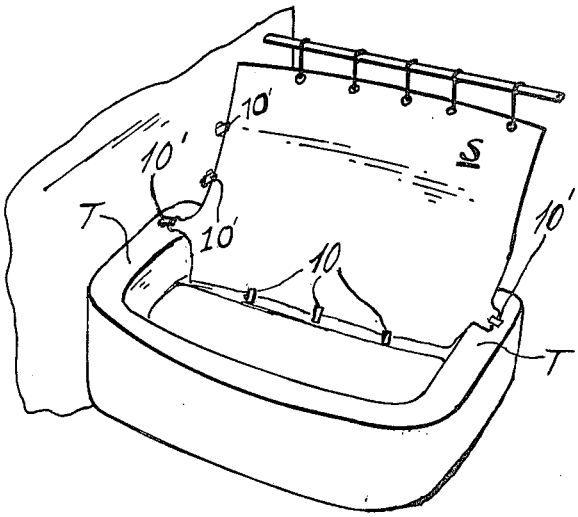
FIG. 4 is a perspective view of a shower curtain secured by the device of this invention to the inside of a bathtub.

In actual use, a number of these curtain holders will be used to safely secure a shower curtain in a desired, non-billowing position. For example, as shown in FIG. 4, a number of clips 10 will be secured in space-apart relationship along the bottom edge of a shower curtain so as to secure the lower edge portion thereof to the sidewall of the tub or shower stall. In addition, a number of clips 10' could also be secured in spaced apart relationship along a lateral edge of the shower curtain so as to secure the curtain to a tub ledge "T" of shower enclosure wall. This arrangement brings the lateral edge beyond the usual tub edge and prevents shower water from falling outside the wall area. The re-positioning of the shower curtain is easily accomplished by simply releasing the suction cup and rearranging them in any desired location.

As can be appreciated, the curtain holder of the present invention is extremely advantageous since, as a result of its frictional engagement, it does not damage the shower curtain in any way. In addition, it is extremely versatile, in contrast to conventional magnet-type holders, since it may also be used on both non-metal based tubs, such as fiberglass tubs, as well as on porcelain, ceramic or plastic walls. Furthermore, the curtain holder will easily accommodate both thin and thick curtains as a result of its resiliency and spring action, in contrast to previous snap-button type clips which do not work particularly well on thick curtains.

The elastomeric materials suitable for the vacuum cup include without limitation rubbers, vinyl and other resilient synthetic resins.

While only one embodiment of the invention has been shown and described, it should be appreciated that many changes and modifications may be made thereto without departing from the spirit and scope of the invention.

What is claimed is:

1. A shower curtain holder for detachably securing an edge portion of a shower curtain to a surface, comprising:

a curtain holder including means for detachably securing said curtain holder to an edge portion of a shower curtain, said means comprising a resilient, plastic generally U-shaped clip having first and second arms which cooperate to frictionally engage an edge portion of a shower curtain inserted therebetween, said first arm comprises an elongated, flat, rectilinear strip having an inner side surface and an outer side surface and said second arm comprises an elongated, flat generally S-shaped strip having a lower end portion which merges with said first arm and an upper end portion which is disposed closely adjacent to at least a portion of said inner side surface of said first arm for cooperation therewith so as to define a generally V-shaped entryway and so as to frictionally engage an edge portion of a shower curtain inserted therebetween; and a suction cup secured to said outer side surface of said first arm of said curtain holder for detachably securing said curtain holder and, in turn, the edge portion of a shower curtain secured thereto, to a surface.

2. The shower curtain holder according to claim 1, including a boss extending outwardly from said inner side surface of said first arm immediately above said V-shaped entryway to provide a grasping means for said shower curtain.

* * * * *